United States Patent [19]

Jones

[11] Patent Number: 4,875,625

[45] Date of Patent: Oct. 24, 1989

[54] CONSTANT FLOW DEIONIZED WATER SPRAY GUN

[75] Inventor: Bruce A. Jones, Hopkinton, Mass.

[73] Assignee: Digital Equipment Corporation, Maynard, Mass.

[21] Appl. No.: 107,620

[22] Filed: Oct. 9, 1987

[51] Int. Cl.[4] ..... B05B 9/00

[52] U.S. Cl. ..... 239/124; 239/526

[58] Field of Search ..... 239/124, 125, 526, 527, 239/528, 583

[56] References Cited

U.S. PATENT DOCUMENTS

| | | | |
|---|---|---|---|
| 3,589,610 | 6/1971 | Wahlin et al. | 239/125 |
| 4,448,355 | 5/1984 | Roman | 239/526 |

FOREIGN PATENT DOCUMENTS

| | | | |
|---|---|---|---|
| 1004217 | 3/1952 | France | 239/124 |
| 1184103 | 7/1959 | France | 239/124 |
| 577176 | 5/1946 | United Kingdom | 239/124 |

*Primary Examiner*—Andres Kashnikow
*Assistant Examiner*—Michael J. Forman
*Attorney, Agent, or Firm*—Fish & Richardson

[57] ABSTRACT

A water spray gun that provides for constant flow both in its on and off condition. The gun includes a valve that in the off position is seated to plug an ejection nozzle, but permit the water to flow from an inlet to a drain outlet. In the on condition, the valve is situated between the inlet and the drain outlet.

9 Claims, 1 Drawing Sheet

CONSTANT FLOW DEIONIZED WATER SPRAY GUN

BACKGROUND OF THE INVENTION

1. Field of the Invention

The invention relates generally to the field of apparatus used in the manufacture of integrated circuits, and more particularly to an arrangement for inhibiting bacterial and algal contamination in the water supply used in the manufacturing process. The invention provides a new and improved deionized liquid spray gun in which the liquid flows continuously to eliminate the stagnation of the water which is conducive to bacterial and algal growth.

2. Description of the Prior Art

Modern society depends on the reliability of many types of semiconductor devices. In order to meet the vast need for such devices, manufacturing facilities fabricate thousands of semiconductor devices simultaneously. Such large scale fabrication is accomplished by creating hundreds of devices on a single wafer of silicon and handling many wafers at one time. A problem with any portion of the manufacturing process will result in the manufacture of a large number of devices which may prove unreliable in use, if they work at all. One of the problems that confronts the manufacturer of semiconductor devices is contamination of the wafers. The nature of semiconductors makes them highly susceptible to contamination in any form and one source of contamination is the deionized water supply.

A semiconductor device is fabricated in a number of sequential process steps by impregnating specific ions, called impurities, into a silicon wafer. The nature and amount of impurities must be strictly controlled if the device is to function properly. Water is used between the processing steps to wash the wafers and that water must be free of ions so as not to introduce ions beyond those required by the process.

To prevent the growth of bacteria or algae in the tubing which distributes the deionized water to the fabrication areas, the water is kept in constant flow. When the water is not being used, the plumbing permits the deionized water to be returned to the deionized water supply. This distribution system is referred to as a continuous flow loop.

Each fabrication area has deionized water supplied to spray guns for general use such as rinsing the silicon wafers. A problem arises in that these spray guns do not contain continuous flow loops. As a result, the water in the tube leading to the gun and the water remaining in the gun itself is stagnant when the gun is not in use. Stagnant water is an ideal medium for growth of bacteria and algae so that when the gun is eventually used, the bacteria, algae and their metabolic products which are formed within the gun contaminate the deionized water flowing through it. Although maintaining a continuous flow loop up to the inlet of the gun reduced bacterial and algal growth in the water supply tube, it did nothing to reduce the growth of bacteria and algae within the gun itself.

SUMMARY OF THE INVENTION

The invention provides a new and improved deionized liquid spray gun which provides a continuous flow loop through the body of the gun itself.

In brief summary, the new spray gun includes a barrel having a forward discharge end and a rear end, a handle and a spring loaded actuator. The handle maintains a liquid inlet path toward the discharge end of the barrel which allows liquid to discharge into the barrel and a liquid outlet path toward the rear end of the barrel which allows water to drain from the barrel. The actuator slides in the barrel between an off position in which it is located forwardly of the inlet path to seal off the discharge end, and an on position in which it is situated between the inlet path and the outlet path. When the actuator is in the off position, it prevents water from discharging from the nozzle of the gun and instead directs the water to pass from the water inlet path through the chamber of the gun and out through the water outlet path in a continuous flow loop. When the actuator is in the on position, the actuator blocks flow between the inlet path and the water outlet path and allows liquid to be discharged from the nozzle of the gun.

BRIEF DESCRIPTION OF THE DRAWING

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1A:
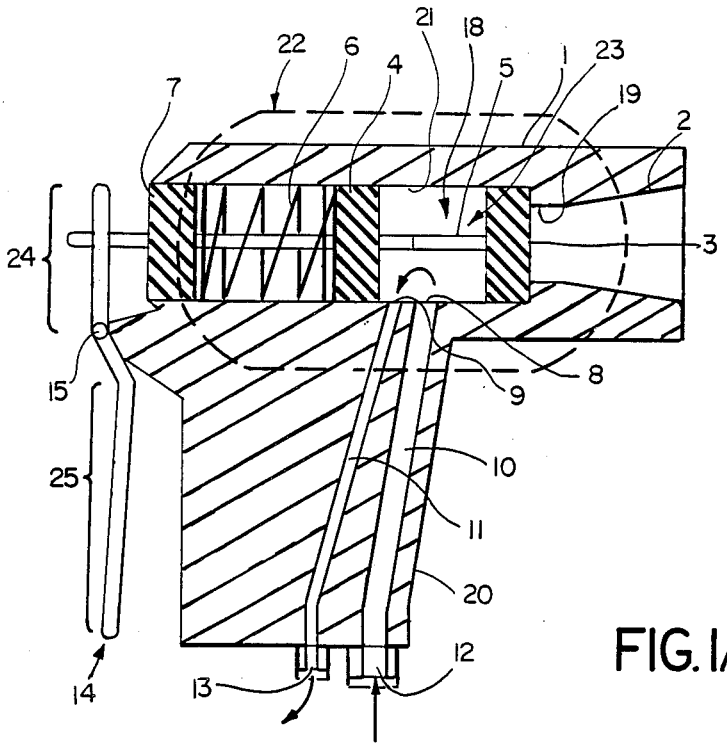
FIG. 1 is a side sectional view of the new spray gun in the off condition.
FIG. 1B is a side sectional view of the spray gun in the on condition.

With reference to the FIGURES, a constant flow deionized spray gun constructed in accordance with the invention includes a barrel 1, a handle 20 depending from the barrel 1, and an actuator 22 which controls the flow of water between the handle 20 and the barrel 1 as described below. The barrel 1 includes a generally cylindrical sidewall 21 defining a bore 18 which expands into a nozzle 2 at a forward discharge end. The rear end of barrel 1 is closed off by an end cap comprising a static seal 7.

The handle 20 generally depends from the rearward end of the barrel 1 with the rear end (the right, as shown in the Figs.) of the handle being proximate to the static seal 7. The handle 20 defines a supply channel 10 which extends upwardly from a apply inlet 12 at the lower end of the handle 20 and through the barrel sidewall 21 at a bore inlet 8. The handle 20 also defines a return channel 11 which extends from a drain outlet 13 at the lower end of the handle through the barrel sidewall to create a bore outlet 9 which is located rearwardly of bore inlet 8. The supply inlet 12 may be connected to a source of liquid (not shown) such as water, and the drain outlet 13 may be connected to a drain or sink (not shown).

The actuator 22 includes a trigger 14 which is essentially a lever pivotally mounted on a fulcrum 15 extending from the rear of the handle 20 to define an upper portion 24 and a lower portion 25. A nozzle seal 3 and spring retaining seal 4 are fixedly attached to a connecting rod 5 and slidably mounted within the bore of the barrel 18. The nozzle seal 3 and spring retaining seal 4 are separated from each other to form, with the bore 18, a chamber 23. The connecting rod 5 extends through the static seal 7 and attaches to the upper portion 24 of trigger 14. A compression spring between the static seal 7 and the spring retaining seal 4 normally urges the spring retaining seal forwardly, to thereby urge the nozzle seal 3 forwardly to seat against a nozzle orifice 19.

In the off condition, depicted in FIG. 1A, the handle 14 is left free to permit the spring 6 to force the spring retaining seal 4, the connecting rod 5 and the nozzle seal 3 forward until the nozzle seal 3 seats against the nozzle orifice 19. Since the nozzle seal 3 is forward of the bore inlet 8, the nozzle seal 3 obstructs any flow of water from the bore inlet 8 through the nozzle 2. In that condition, both the bore inlet 8 and the bore outlet 9 are situated between the spring retaining seal 4 and the nozzle seal 3. Accordingly water from the supply channel 10 and bore inlet 8 flows into the chamber 23 between the nozzle seal 3 and spring retaining seal 4, and flows out through the bore outlet 9. Thus in the off condition water continues to flow through the gun reducing or eliminating the likelihood of bacterial or algal contamination.

Figure 1B:
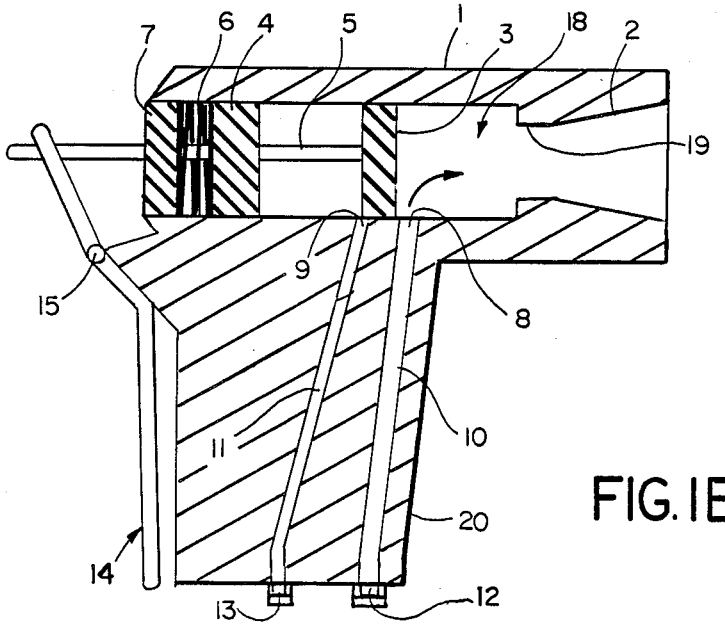

In the on condition, depicted in FIG. 1B, the actuator 22 is actuated by forcing the lower end 25 of the trigger 14 forwardly towards the handle 20. In that condition the connecting rod 5, the spring retaining seal 4 and the nozzle seal 3 are moved as a unit rearwardly so as to situate the nozzle seal 3 between the bore inlet 8 and bore outlet 9, thereby preventing water from the bore inlet 8 to flow toward bore outlet 9. This position now allows the bore inlet 8 to communicate with the nozzle orifice 19 and water to issue from the nozzle 2. The movement of the spring retaining seal 4 rearwardly causes the spring 6 to compress and to provide a restoring force which moves the seals to the off position when pressure on the lower end 25 of trigger 14 is released.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A spray gun comprising:

A. barrel means including a generally cylindrical sidewall defining a bore and having a forward open discharge end, inlet means through said sidewall adapted to permit a fluid to enter said barrel means, and outlet means through said sidewall situated generally rearwardly from said inlet means; and B. actuator means including sealing means situated in said bore and configured to sealingly engage said sidewall of said barrel means and means for moving said sealing means between an on position forward of said inlet means and an an position between said inlet means and said outlet means, so that when said sealing means is in said off position fluid flowing into said bore through said inlet means flows out said outlet means, and when said sealing means is in said on position fluid flowing into said bore through said inlet means flows out said discharge end of said bore.

2. A spray gun as defined in claim 1 further including handle means depending from said barrel means, said handle means defining inlet passage means which communicates with said inlet means to facilitate the passage of fluid therethough into said bore and outlet passage means which communicates with said outlet means to facilitate passage of fluid therethrough from said bore.

3. A spray gun as defined in claim 2 further including trigger means mounted on said handle means and connected to said actuator means for moving said actuator means between said on position and said off position.

4. A spray gun as defined in claim 3 wherein:

A. said actuator means further includes a connecting rod connected to said sealing means and extending substantially parallel to the axis of said barrel means through the rear end of said barrel means; and B. said trigger means includes an elongated member pivotally mounted on said handle means, connected to said connecting rod, so that pivoting of said elongated member moves said connecting rod along the axis of said barrel means to, in turn, move said sealing means between said on position and said off position.

5. A spray gun as defined in claim 4 further comprising biasing means for normally biasing said sealing means toward said off position.

6. A spray gun as defined in claim 5 wherein said sidewall includes nozzle orifice means for preventing said sealing means from moving forwardly thereof to thereby define said off position for said sealing means, and said barrel means includes rear closing means for closing off said rear end of said bore, said biasing means including compression spring means within said bore between said sealing means and said rear closing means for biasing said sealing means toward said nozzle orifice means.

7. A spray gun comprising:

a. a barrel including:

i. a sidewall defining a cylindrical bore having a forward discharge end and a rear end, said sidewall having a nozzle orifice proximate said forward discharge end, a fluid inlet hole and a fluid outlet hole through said sidewall, said fluid outlet hole being generally rearwardly of said fluid inlet hole;

ii. a rear closing plug for closing off the rear end of said bore, said rear closing plug defining an actuator hole proximate the axis of said bore;

B. a handle depending from said barrel and connected to said sidewall, said handle including a fluid inlet passage for permitting fluid to flow into said fluid inlet hole into said bore and a fluid outlet passsage for permitting fluid to flow from said bore through said fluid outlet hole, said handle including a rear projection defining a fulcrum;

C. an actuator comprising:

i. a movable sealing plug situated within said bore, said sealing plug having a forward sealing surface;

ii. a connecting rod connected to said movable sealing plug and extending rearwardly thereform through said actuator hole;

iii. a biasing spring in said bore extending between said rear closing plug and said sealing plug for biasing said sealing plug forwardly to normally situate it against said nozzle orifice; and iv. a trigger comprising an elongated member mounted intermediate its ends on said fulcrum, one end being connected to the portion of said connected rod extending through said acutator hole, said trigger being pivotable to move said sealing plug such that said forward sealing surface moves between an off position between said inlet hole and said discharge end and an on position between said inlet hole and said outlet hole, so that the when the sealing plug is in the off position, fluid flow from said inlet hole to said outlet hole so that said fluid continues flowing when said sealing plug is in the off position.

8. A spray gun comprising:

A. barrel means including a generally cylindrical sidewall defining a bore and having a forward open discharge end, inlet means through said sidewall adapted to permit a fluid to enter said barrel means, and outlet means through said sidewall situated generally rearwardly form said inlet means; and B. actuator means including a cylindrical sealing plug, having a forward sealing surface, situated in said bore and configured to sealingly engage said sidewall of said barrel means and means for moving said cylindrical sealing plug such that said forward sealing surface moves between an off position forward of said inlet means and on position between said inlet means and said outlet means, so that when said cylindrical sealing plug is in said off position fluid flowing into said bore through said inlet means flows out said outlet means, and when said cylindrical sealing plug is in said on position fluid flowing into said bore through said inlet means flows out said discharge end of said bore.

9. A spray gun comprising:

A. barrel means including a generally cylindrical sidewall defining a bore and having a forward open discharge end, inlet means through said sidewall adapted to permit a fluid to enter said barrel means, and outlet means through said sidewall situated generally rearwardly from said inlet means; and B. actuator means including sealing means, having a forward sealing surface, situated in said bore and configured to sealing engage said sidewall of said barrel means and means for moving said sealing means such that said forward sealing surface moves between an off position forward of said inlet means and on position between said inlet means and said outlet means, so that when said sealing means is in said off position fluid flowing into said bore through said inlet means flows out said outlet means, and when said sealing means is in said on position fluid flowing into said bore through said inlet means flows out said discharge end of said bore.

* * * * *